US005884683A

United States Patent [19]

Sears

[11] Patent Number: 5,884,683

[45] Date of Patent: Mar. 23, 1999

[54] SYSTEM FOR CONVERTING SLIDING DOORS TO HUNG DOORS

[76] Inventor: Michael R. Sears, 11077 Brownstone Dr., Parker, Colo. 80134

[21] Appl. No.: 887,737

[22] Filed: Jul. 3, 1997

[51] Int. Cl.[6] ..... A47H 1/00

[52] U.S. Cl. ..... 160/90; 160/128; 49/168

[58] Field of Search ..... 160/91, 90, 105, 160/128; 49/168

[56] References Cited

U.S. PATENT DOCUMENTS

| | | | |
|---|---|---|---|
| D. 361,629 | 8/1995 | Tweedt . | |
| 3,086,628 | 4/1963 | Robinson . | |
| 3,288,511 | 11/1966 | Tavano . | |
| 3,291,192 | 12/1966 | Jones, Jr. | 160/91 |
| 3,579,934 | 5/1971 | Pietsch . | |
| 3,589,067 | 6/1971 | Knaap . | |
| 4,167,088 | 9/1979 | Governale . | |
| 4,478,267 | 10/1984 | Smiley . | |
| 4,680,828 | 7/1987 | Cook et al. . | |
| 4,838,332 | 6/1989 | Mlenek . | |

FOREIGN PATENT DOCUMENTS

| | | |
|---|---|---|
| 551659 | 11/1956 | Italy . |
| 1530591 | 1/1978 | United Kingdom . |

*Primary Examiner*—Blair M. Johnson
*Attorney, Agent, or Firm*—Ramon L. Pizarro

[57] ABSTRACT

A system and method for converting a sliding door installation in which the door is mounted within at least one section of track mounted on the upper, or lintel, side of the door opening into a swing open or hinged door. According to one aspect an elongate support member that includes a first end and a second end is used. The first end of the elongate member adapted for insertion into the section of track mounted on the lintel side of the door opening. A mechanism for hingedly supporting a door from the elongate support member is also included, so that the hinged door may be supported from the elongate support member to close off at least part of the door opening. According to another aspect, a system or kit is taught for converting a hinged, bi-folding door to a hinged, double door system. The kit allows the use of the existing doors by providing a set of spacers that allow proper fit of the existing doors and allow clearance for the hinges within the door opening.

4 Claims, 6 Drawing Sheets

SYSTEM FOR CONVERTING SLIDING DOORS TO HUNG DOORS

BACKGROUND OF THE INVENTION (a) Field of the Invention

This invention generally relates to a method and system for converting existing sliding or track door installations to swing open or hung door systems. More specifically, but not by way of limitation, to a system and method for using the existing doors of a track based system to convert the track based system to a swing away or hung door.

(b) Discussion of Known Art

Many homes as well as offices and other structures make use of sliding door mechanisms for supporting screen doors, bi-folding doors and the like. The sliding door mechanisms typically include tracks which accept the wheels and travel mechanism of the sliding door. Unfortunately these tracks and travel mechanisms frequently fail due to wear or poor design practices. Typical locations of failure include wear of the tracks or the wheels and other traveling mechanisms that are incorporated into the door itself. The failure of any of these mechanisms is usually a difficult problem to repair.

For example, one area of failure of the systems is failure of the track. The track is usually permanently attached to the structure, and not easily replaced for repair. Also, sections of track are typically sections of extruded aluminum which can accommodate some, but not all sliding mechanisms. Thus when the track portion fails due to deformation or wear the user has to accept the poor working condition of the track system or tear out and replace the entire track with track sections that match the wheels, or change the track sections as well as the wheels or other sliding mechanisms found on the door.

Solutions that address the problems associated with failed sliding systems of sliding screen doors, bi-folding doors and the like typically call for replacement of the wheels on the door or replacement of the track as well as the wheels. Other approaches, such as taught in U.S. Pat. No. 4,478,267 to Smiley teach attachment of a screen door to the sliding door on a sliding door system. The Smiley invention, however, is disadvantaged in that it uses one of the sliding doors to support the screen door. This results in a system that can allow the screen door to be kept in a partially open position if the sliding door is not at a position on the track that allows the screen door to reach the frame of the door assembly. Also, the Smiley device is particularly useful when the sliding door is in a fully closed position or in a fully open position. The screen door will not close properly in situations where the sliding door is somewhere between fully open or fully closed.

Another example of known art is taught in U.S. Pat. No. 4,838,332 to Mlenek. The Mlenek invention teaches a swinging screen door for sliding glass doors. The swinging screen door of the Mlenek invention mounts in a secondary frame that attaches to the frame of the sliding glass doors. The Mlenek device provides a solution for situations where a swinging door needs to mounted next to the sliding glass door. However, the secondary frame structure required by the Mlenek device can complicate the installation by requiring frame members that can accept or mount over the existing, primary door frame.

Thus it can be appreciated from the above discussion that there remains a need for a system for replacing a sliding door, particularly a sliding screen door or bi-folding doors, with a swing away door system. Importantly, there remains a need for a system that requires little modification of the existing sliding door installation to mount. Moreover there remains a need for a system that is economical, simple, and that can be used with any of the common or well known hinged or hung door mounting systems.

It will also be understood that there remains a need for a simple mounting structure that takes advantage of as much of the existing structure as practicable.

It has been discovered that the problems left unanswered by known art can be solved by providing a system for converting sliding door installations, such as sliding screen doors or bi-folding doors into swing away or hung door systems which include a track for the sliding doors. A preferred embodiment of the invention includes:

a) an elongate support member that includes a first end and a second end, the first end and the second end being adapted for insertion into the track used with the sliding doors; and b) means for hingedly supporting a door from the elongate support member.

In a preferred embodiment of the invention the elongate support member is made from a furring strip which is retained in the track by means of a fastener through the track and one of the ends of the elongate support member. Additionally, the system may include a section of material that serves to seal off any gaps between the elongate support member and the glass panel in the sliding glass door installation as well as to stiffen the elongate support member.

The elongate support member provides a surface from which a swing open, or hung, type door may be supported. Accordingly, in a highly preferred embodiment of the invention the practice of the system includes a method that allows the user to convert the existing sliding screen door into a hinged, or hung, door. Clearly it is contemplated that a replacement swing-open, or hinged, screen door may be used to replace a sliding screen door which may have been previously mounted in the support frame of the sliding glass door structure. However, the instant invention allows the user to use a few simple components to convert the existing sliding door into a hinged installation.

It is important to note that the instant invention accommodates any width door. Thus, while the preferred embodiment of the invention makes use of the existing screen door, it is contemplated that the user may use the invention with any door of a standard height and replace the sliding screen door.

Yet another feature of a highly preferred embodiment of the invention is that since the system uses the existing frame structure of the sliding screen door, the user does not have to replace or modify the frame structure of the sliding doors to mount the a hinged screen door over the sliding door.

According to another embodiment taught herein, a kit and a method for converting bi-folding doors to swing away or hung type doors is disclosed. According to this embodiment the user can convert existing bi-folding doors to hinged, hung, doors that use the existing door opening in the structure.

Well known bi-folding doors comprise of at least two rectangular panels that are hinged together along an edge. A section of track is attached below the lintel of the door opening. One of the two panels includes a pivot pin which mounts in a pivot pin receiver near or along the track. The other panel includes a rolling or sliding mechanism that rides in the track and which allows the folding of the two panels along the hinge. In order to convert the bi-folding door installation to a hinged door installation a kit as taught herein is used to provide the necessary hardware and transform the bi-folding doors into hinged doors. The kit for transforming a bi-fold installation to a hung installation includes the following elements:

1) a set of spacers for mounting against the door opening and supporting a hinge;

2) a set of hinges, preferably a pair of hinges, for mounting on the spacers and supporting the doors; and 3) means for retaining the doors in a closed position.

In the preferred embodiment of the invention, the kit is used to transform a two panel bi-folding door installation into a double door, hinged door installation. Transformation begins with the user first removing the double paneled bi-fold door from the track and pivot pin receivers. The track, which is typically found on the lintel side of the opening, may be removed if desired. The bi-fold hardware is then removed from the bi-fold door to separate each panel into two separate panels. The spacers are then placed against the vertical sides of the door. The hinges are then mounted on each of the panels of the original bi-fold door. The hinges and door panels are then mounted over the spacers. The means for retaining the doors in a closed position is then attached to the opening and to the doors if necessary.

The spacers are mounted on the vertical sides of the opening of the door to support hinges that will used to hang the hinged doors and to provide enough clearance for the hinge mechanisms to fit between the door and the door opening and any existing moldings that may be found along the door opening. Also, since the bi-folding doors are of a size to allow sufficient clearance to permit movement within the door opening, the spacers have been adapted for allowing the door panels to fill the door opening and square the door, and may even be used to allow the door panels to clear any side moldings that may be present.

Thus it will be appreciated that these disclosed embodiments allow the replacement of track mounted doors bi-folding doors with hinge mounted doors. Importantly, the instant invention allows the conversion of track mounted installations to hinged installations without having to replace the existing doors.

It will be appreciated that the disclosed invention allows the installer to use the existing installation to convert the door into a hinged door system. Thus this embodiment allows the user to convert the door system with minimum waste.

It has been discovered that an advantage of the instant invention is that most sliding screen door installations, as well as most bi-folding door installations may be converted to hinged, or hung, doors with a few simple components, without wasting or having to dispose of the existing door panels.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

Figure 3:
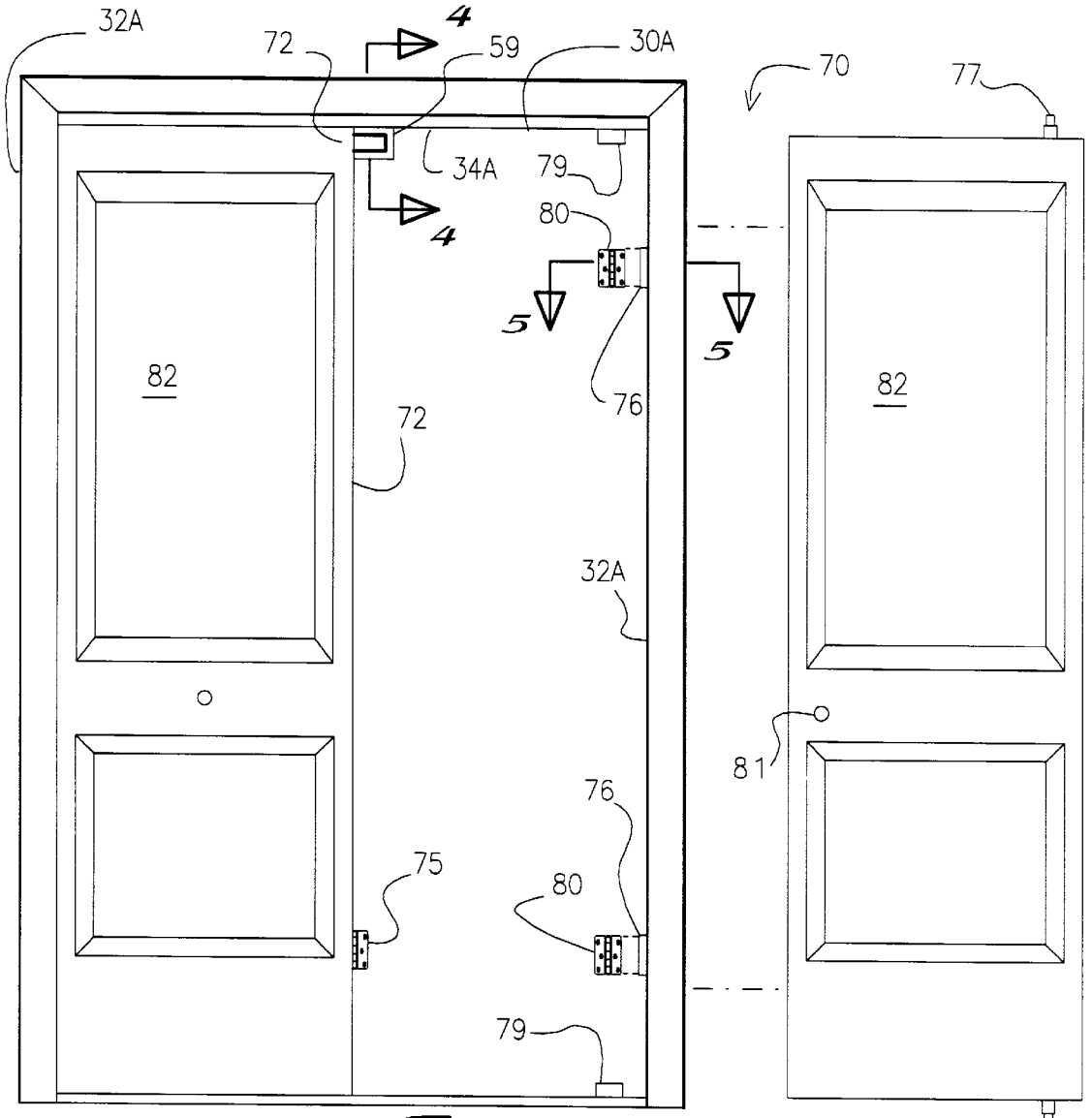

FIG. 3 is an elevational view showing a conversion of a double panel bi-folding door. One of the panel, now converted to a single door panel, is shown mounted within the door opening. The other door panel is shown apart from the door opening to illustrate components of the kit.

Figure 3A:
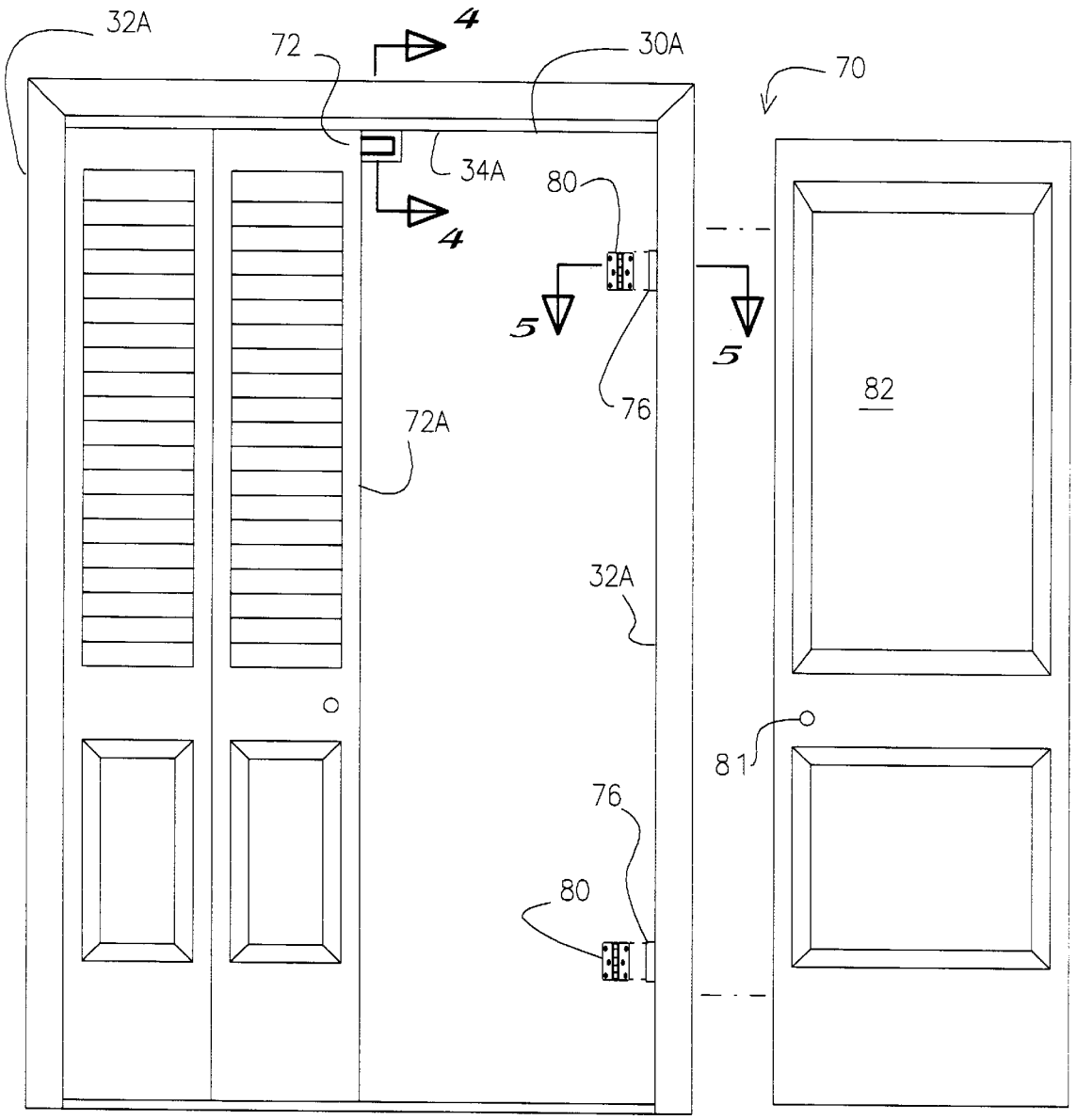

FIG. 3A is an elevational view of a set of bi-folding doors mounted on a door opening. The view shows that a pair of bi-folding doors have been mounted on the door opening. The bi-folding doors have been removed. One of the doors has been mounted in the opening, and the other door has been shown away from the opening.

Figure 4:
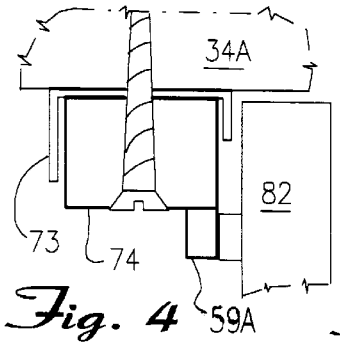

FIG. 4 is a section taken from FIG. 3, and shows a means for retaining the hinged door in a closed position.

Figure 4A:
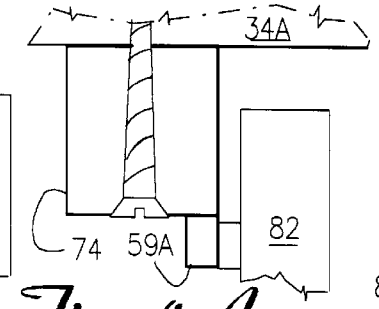

FIG. 4A shows another installation of the means for retaining the hinged door in a closed position.

Figure 5:
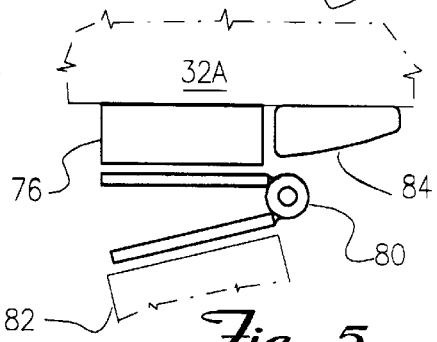

FIG. 5 is a section taken from FIG. 3 and shows the mounting of the use of a spacer as taught herein as well as the mounting of hinges and a hinged door.

Figure 6:
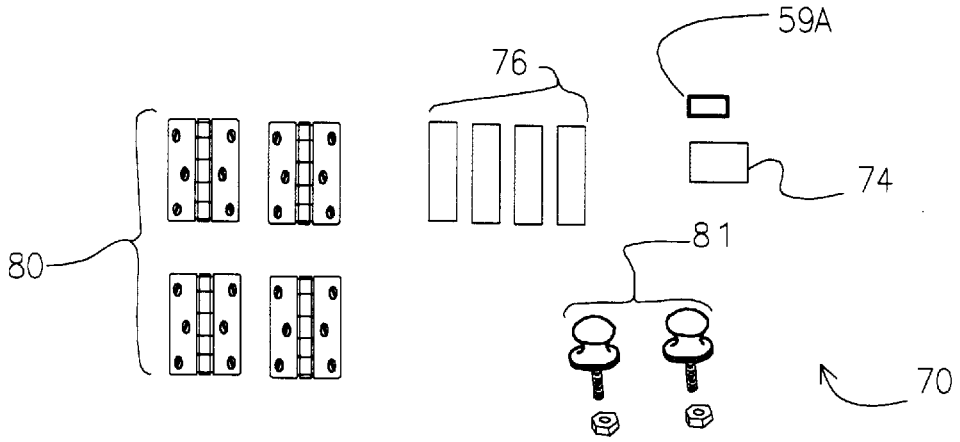

FIG. 6 illustrates components for a kit for converting bi-folding doors to hinged doors.

Figure 7:
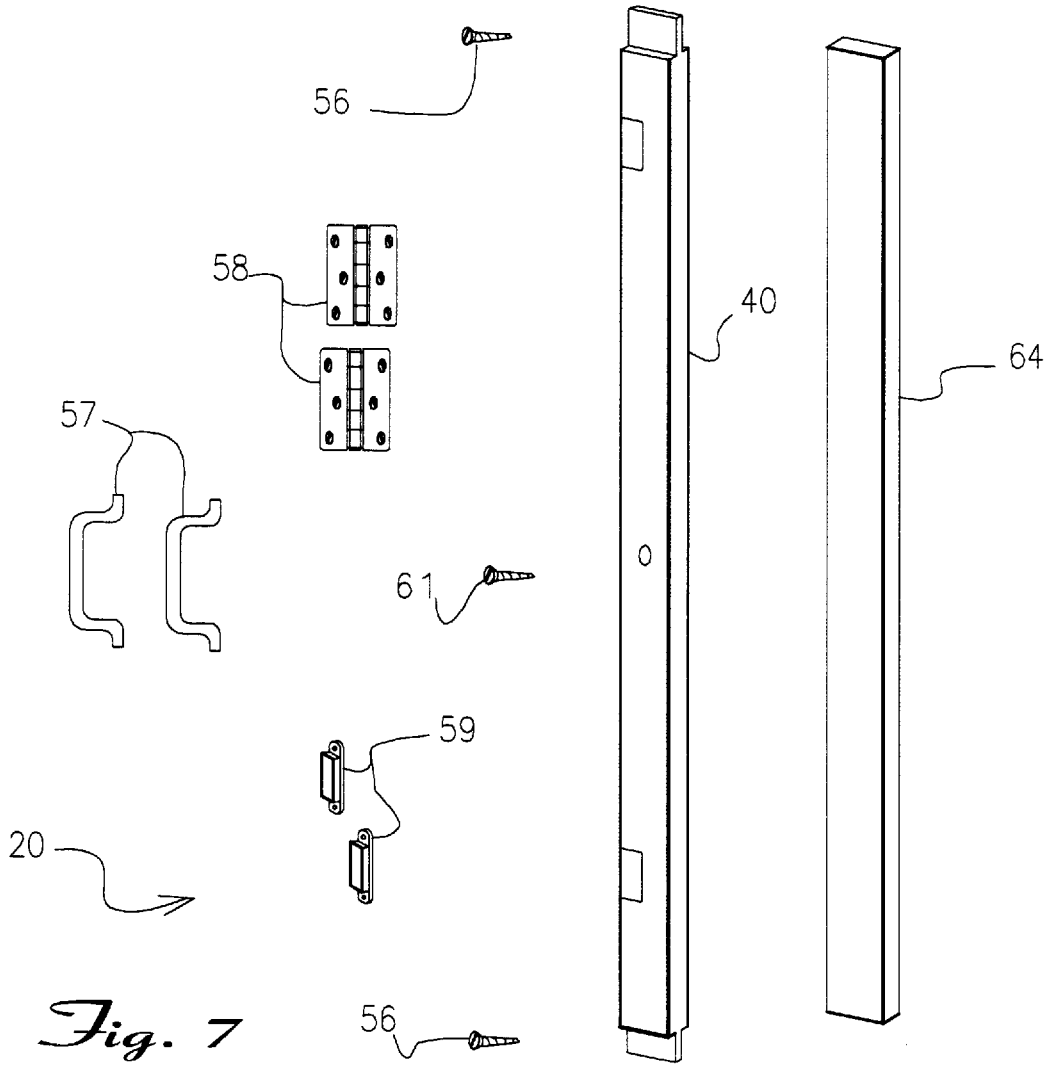

FIG. 7 illustrates components for a kit for converting a screen door to a hinged door.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
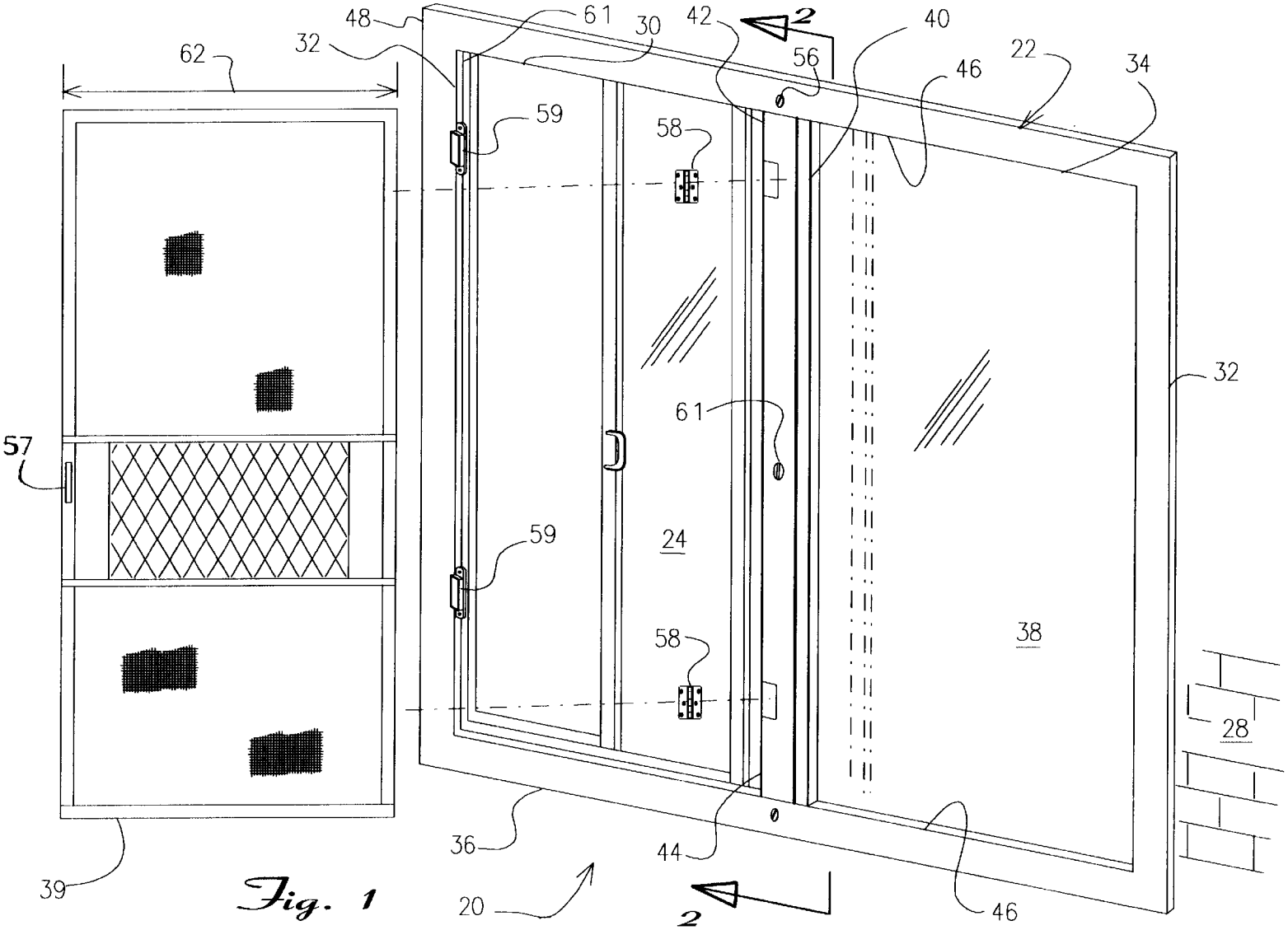
FIG. 1 is a perspective view showing a sliding glass door and use of the instant invention to hingedly mount the screen door as a hinged door over the sliding glass door installation.
Figure 1A:
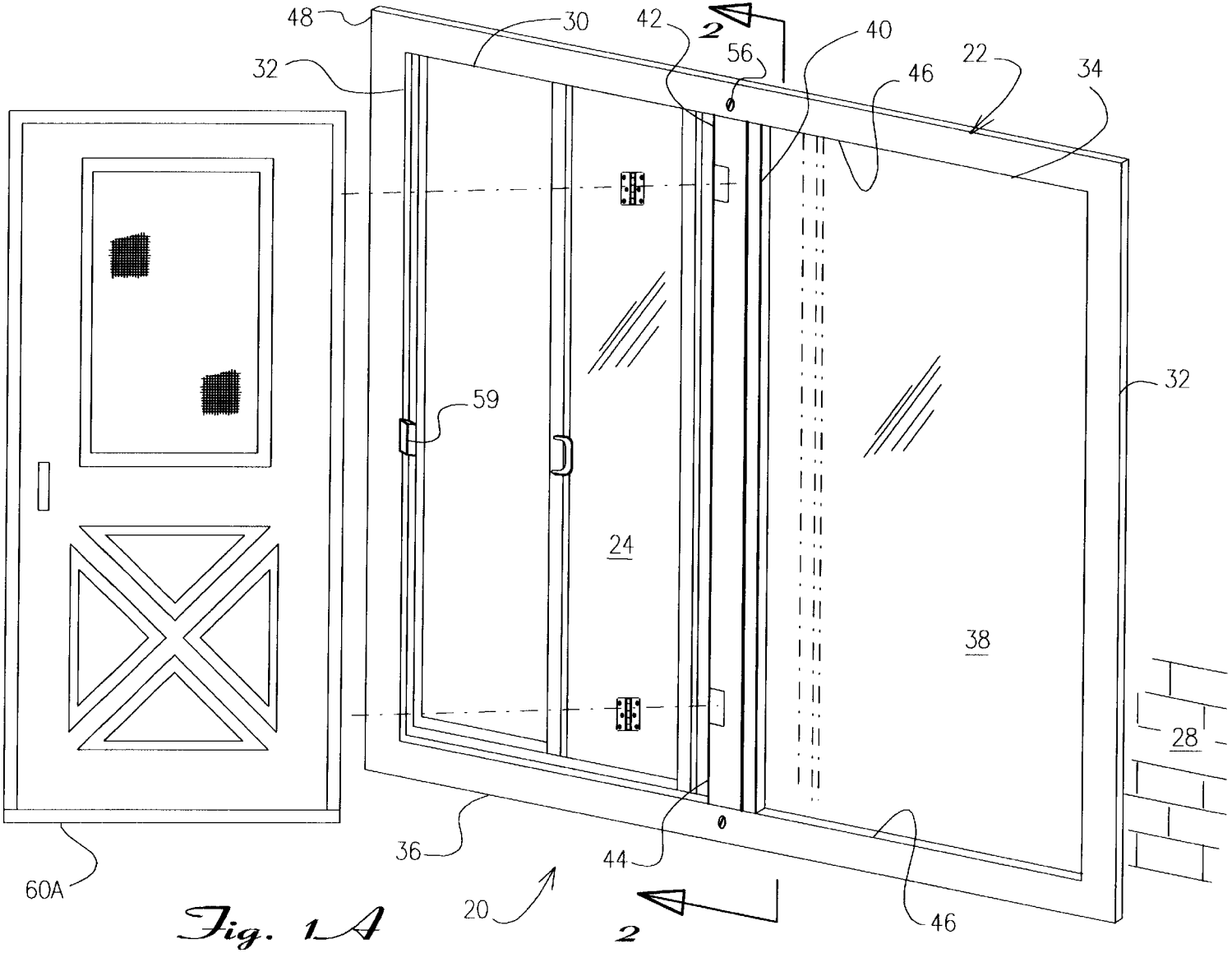
FIG. 1A is a perspective view showing a sliding glass door and the use of the instant invention with a new screen door.

Turning now to FIG. 1 where a system 20 or kit for converting a door installation 22 in which a sliding door 24 is mounted within at least one section of track 26, the sliding door 24 is mounted within a structure 28 which includes a door opening 30. The door opening 30 includes at least two vertical sides 32, a lintel side 34, and a lower side 36 opposite to the lintel side 34. A section of the track 26 is mounted on the lintel side of the door opening 30.

The door installation 22 shown on FIG. 1 is typical of the sliding glass door installations used to allow access to and from the interior of a house and to a patio or the like. It is important to note that while the door installation 22 shown on FIG. 1 includes only a two panel sliding door, with a sliding door 24 and a stationary panel 38, it is also contemplated that the system may be used with sliding door installations which include more than one sliding section.

As is well known, many sliding glass door installations include a sliding screen door which mounts on a track that is closer to the exterior of the building and parallel to the sliding glass doors. These sliding screen doors ride in a track section that is parallel to the track section that supports the sliding glass doors. Unfortunately, these sliding screen doors frequently become inoperative due to failure of the systems that allow them to move within the track or due to deformation of the screen door itself. Repairing the systems that allow the screen door to move within the track is often a difficult task, especially for the unskilled homeowner. Therefore the screen door is frequently simply removed, allowing insects to enter the structure, and which leads to avoidance of leaving the sliding glass doors open to allow the circulation of air through the building.

Figure 2:
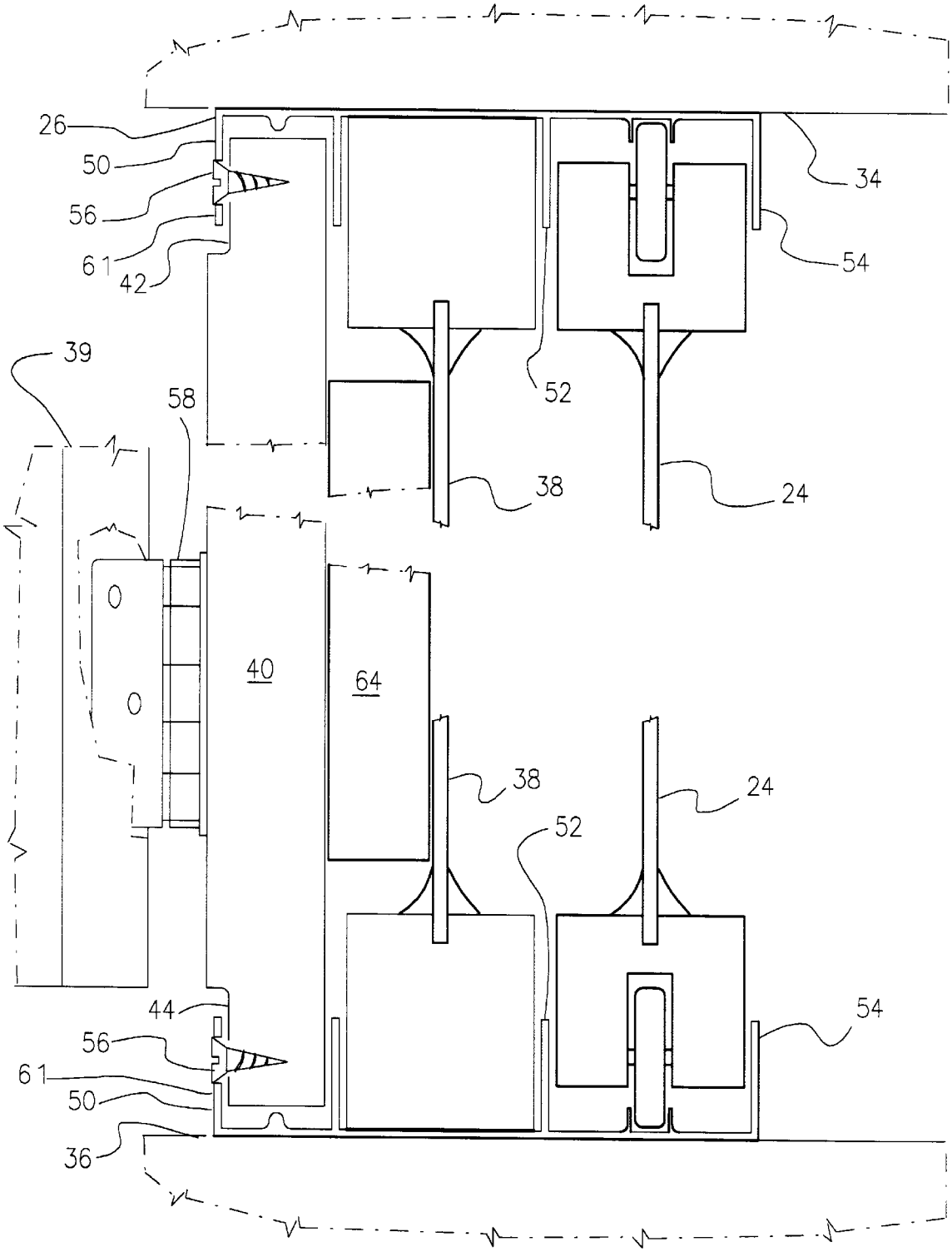
FIG. 2 is a section taken from FIG. 1, and shows the positioning of the tracks as well as the elongate support member within the tracks. The view also shows the sliding glass door installation.

Referring now to FIGS. 1 and 2 where the screen door track 46 has been illustrated together with the sliding door 24 and the stationary panel 38. The sliding door 24, the stationary panel 38 and the sliding screen door are typicially mounted on a frame 48 which includes sections of track that support the different panels. Thus as shown on FIG. 2 the frame 48 includes a screen door track 50, a stationary panel slot 52, and a sliding panel track 54.

A preferred embodiment of the system 20 which has been illustrated in FIGS. 1 and 2 includes an elongate support member 40 that includes a first end 42 and a second end 44. A kit of the system 20 has been illustrated in FIG. 7. As can be seen on FIG. 2, the first end 42 of the elongate support member 40 has been adapted for insertion into the section of screen door track 50 which has been mounted on the lintel side 34 of the door opening 30. The position of the elongate support member 40 relative to the screen door track 46 is fixed by a fastener 56. It is important to note that the fact that the elongate support member 40 has been adapted for insertion or support from the sliding screen door track 50 allows the insertion and attachment of the elongate support member anywhere along the screen door track 46. This allows the system to be used with hinged doors of a variety of widths, without having to ensure that the width of the replacement door matches the opening at the installation site.

Also shown on FIGS. 1 and 7 is the inclusion of an intermediate fastener 61 to further stiffen or reinforce the position of the elongate support member 40 over the frame of the door installation 22 or over the stationary panel 38.

Once the elongate support member 40 has been installed and fastened in the screen door track 50, at least one hinge 58 may then be attached to the elongate support member 40. The hinge 58 may then be used to support a hinged door 60. In a highly preferred embodiment the hinged door 60 is the sliding screen door 39 that was originally mounted within the tracks 46. The screen door 39 has been mounted on the elongate support member 40 by means of the hinges 58. It is important to note that the term "hinged door" as used herein refers to a door that is supported from a support by means of at least one hinge.

Therefore, while the preferred embodiment of the invention contemplates the conversion of the existing sliding screen door 39 into a hinged door by mounting the screen door 39 on the elongate support member 40 by means of hinges 58. Also, as shown on FIG. 1, at least one means for retaining the door in a closed position is used with the invention. In a preferred embodiment of the invention the means for retaining the door in a closed position includes at least one magnetic catch 59. Clearly, while the preferred embodiment includes a magnetic catch 59, it is contemplated that any known catch mechanism may be used to hold the door in a closed position.

As shown on FIGS. 1 and 2, the screen door track 50, which will also include sections of the frame 48 will include an external surface 61. In a highly preferred embodiment of the invention a means for retaining the hinged door 60 in a closed position relative to the door opening 30 is used with the system 20 by attaching the means for retaining the door 60 in a closed position against the external surface 61 of the track 50 or frame 48. These means for holding the hinged door in a closed position may include a catch, a magnetic retention device such as the magnetic catch 59, or one of many know equivalents to these devices. In order to allow the user to open and close the screen door in a convenient manner, a pair of handles 57 will preferably be included with the kit or system 20.

Thus, to install the hinged door 60 the user would first measure the width 62 of the hinged door 60. Then the user would mark the position where the means for retaining the hinged door 60 in a closed position would be mounted. Then, the user would mark the position along the screen door track 50 where the elongate support member 40 should be mounted to accommodate the with of the hinged door. The first end 42 of the elongate support member 40 would then be fastened to the screen door track 50, preferably as shown on FIG. 2. The second end 44 of the elongate support member 40 would then be fastened to the lower side 36 of the door opening 30, either through a section of screen door track 50, or by fastening to the lower side 36 of the door opening 30.

Since there is likely to remain an opening between the elongate support member 40 and the stationary panel 38, or a panel that is next to the elongate support member 40, it is advantageous to install a sealing means to the elongate support member 40. In a preferred embodiment of the invention the sealing means includes a sealing strip 64 of a section of material that serves to stiffen the elongate support member 40 and to seal off any gaps between the elongate support member and the glass panel in the sliding glass door. The sealing strip may be made from a section of wood, aluminum, rubber or the like.

Referring now to FIGS. 3 through 5, where another embodiment of the-invention has been shown. In the embodiment shown in FIGS. 3 through 5 comprises a conversion system 70, or kit, for converting bi-folding doors 72 to hinged, or swing open, doors. The system may be conveniently sold as a kit to allow the installer to convert a set of bi-folding doors 72 into hinged, or hung doors. The original bi-folding door 72 has been mounted in a door opening 30A which includes vertical sides 32A, a lintel side 34A, and a lower side 36A. The original bi-folding doors 72 typically include a pair of door panels that are hinged together. One of the panels 71 rides in a top track 73, while the other panel 71 is pivotally mounted against the door opening 30A by means of a pivot pin 77 and a pin receiver 77 that is mounted in the door opening 30A. The pivotal mounting of one panel and the sliding mounting of the other panel allows the bi-folding doors 72 to open in a well known manner.

Turning to FIGS. 3 and 6 it has been shown that the conversion system 70 or kit as taught herein is used to provide the necessary hardware and to transform the bi-folding doors into hinged doors. The kit 70 includes the following elements:

1) a set of spacers 76 which serve as a mounting surface against the door opening 30A;
2) a set of hinges 80 for mounting on the spacers 76 and supporting the door panels 71; and
3) means for retaining the doors in a closed position.

Transformation of a two panel bi-folding door 72 installation into a double hinged door installation with the kit 70 begins with the user first removing the double paneled bi-fold door 72 from the track 73 and pivot pin receivers 79. The track 73, which is typically found on the lintel side 34A of the opening 30A, may be removed if desired.

The bi-fold hardware, meaning the original hinges 75, pivot pins 77 and pivot pin receivers 79, is then removed from the bi-fold door 72 in order to separate the bi-folding door 72 into two separate panels 78. Since the existing door panels 78 will have recesses that will allow the mounting of the hinges that allow the bi-folding door to open, the door panels 78 must be switched to allow the user to take advantage of the recesses to accommodate the hinges used to mount the door panels to the door opening 30A. In other words, the door panel which had originally been against the left side of door opening will now be at the right side of the door opening, so that the recesses will face the vertical sides 32A. This allows full use of the existing door panels and results in a neat installation that does not look like the product of salvaged components.

The spacers 76 are then placed against the vertical sides 32A of the door opening 30A. The original hinges 75 are then mounted on either of the door panels 78. Since a bi-folding door will typically include only one pair of hinges between a single set of panels, a pair of hinges 80 are also included with the kit 70 to allow proper mounting of at least two door panels. The original hinges 75, new hinges 80, and door panels 78 are then mounted over the spacers 76. Means for retaining the doors in a closed position are then attached to the opening 30A and to the door panels 78, if necessary. As shown on FIGS. 3 and 4A, in the preferred embodiment these means for retaining the doors in a closed position include a magnetic catch 59. As shown on FIGS. 3 and 6, the kit 70 should also include at least one knob 81 or handle to allow convenient opening and closing of the modified doors.

The spacers 76 are mounted on the vertical sides 32A of the door opening 30A to support the hinges 80 that will used to hang the door panels 78 and to provide enough clearance for the hinge mechanisms to fit between the door panels 78 and the door opening 30A and any existing moldings that may be found along the door opening 30A. Also, since the bi-folding doors 72 are of a size to allow sufficient clearance to permit movement within the door opening 30A, the spacers 76 have been adapted for allowing the door panels to fill the door opening evenly for enhancing the aesthetic appearance of the final installation. Also, the spacers 76 may be used to allow the door panels to clear any side moldings 84 that may be present about the door opening 30A as shown on FIG. 5. Clearly, the side moldings 84 may be removed by the user if so desired.

Once the door panels 78 have been mounted over the door opening 30A a closure support 74 that is mounted against the lintel side 34A of the door opening 30A. The closure support 74 will preferably include a magnetic latching element 59A. Since the closure support 74 has been mounted on the lintel side 34A of the door opening 30A, proper alignment and positioning of the hinged door 82 is accomplished with ease.

Turning now to FIG. 4 it can be appreciated that the closure support 74 may be attached through the existing top track 73. This alleviates the amount of work to be done to accomplish the task of converting the door installation to a hinged door installation by obviating the need to remove and refinish the areas where the track was mounted. Also, as shown on FIG. 4A, it is contemplated that the closure support 74 may be mounted against the top track 73. This variation would be necessitated by the existing condition, such as the moldings and the like that may be mounted about the door opening 30A. FIG. 3A shows the kit being used to replace a pair of bi-folding doors with two new doors.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A door system on a door opening having a sliding glass door supported on a section of track, the system comprising:

a sliding screen door from an installation in which sliding screen door had been mounted on a plurality of sections of screen door track;

a plurality of section of screen door track, the screen door track including a planar external surface adapted for being parallel to the track that supports the sliding glass door on the door opening, the door opening having at least two vertical sides, a lintel side, and a lower side opposite to the lintel side, the screen door track and the section of track that supports the sliding glass door being mounted on the lintel side, on at least one vertical side and on the lower side of the door opening, the external surface of the sections of screen door track mounted on the door opening being substantially coplanar;

an elongate support member that includes a first end and a second end, and a substantially flat central portion between the first end and the second end, the first end being adapted for insertion into the section of screen door track mounted on the lintel side of the door opening between the external surface of the screen door track and the section of track that supports the sliding glass door, the second end being adapted for insertion between the external surface of the screen door track and the section of track that supports the sliding glass door on the section of screen door track mounted on the lower side of the door opening, the flat central portion of the elongate support being adapted for being approximately coplanar with the external surface of the screen door track once the elongate support member is mounted between the screen door track and the track that supports the sliding glass door on the lintel side and the screen door track and the track that supports the sliding glass door on the lower side of the door opening;

fastening means for holding the first end of said elongate support member against said section of screen door track and fastening means for holding the second end of said elongate support member against said section of screen door track; and hinge means for mounting on the screen door from the installation on the flat central portion of said elongate support member, so that the screen door may be hingedly supported from the elongate support member to close off at least part of the door opening, and so that the screen door rests o the external surface of the screen door track when closing off at least part of the door opening.

2. A system according to claim 1 and further comprising means for retaining said screen door in a closed position against the external surface of the-screen door track, the means for retaining said screen door in a closed position being adapted for mounting on the external surface of the screen door track.

3. A method for converting a sliding screen door installation in which a sliding screen door is mounted within at least one section of screen door track, the screen door track having a planar external surface, into a hinged screen door installation in which the sliding screen door is re-used and hung to close against the external surface of the screen door track, the sliding screen door originally being mounted within a structure having a door opening, the door opening having at least two vertical sides, a lintel side, and a lower side opposite to the lintel side, the screen door track being mounted on the lintel side, at least one vertical side and on the lower side of the door opening and with the external surface of the screen door track being substantially coplanar with a track for supporting a sliding glass door over at least part of the door opening, the method comprising:

removing the sliding screen door from the track;

providing an elongate support member that includes a first end and a second end, the first end being adapted for insertion into the section of screen door track mounted on the lintel side of the door opening and between the external surface of the screen door track and the section of track that supports the sliding glass door, the second end being adapted for insertion into the section of screen door track mounted on the lower side of the door opening and between the external surface of the screen door track and the section of track that supports the sliding glass door, the flat central portion of the elongate support being adapted for providing a substantially flat surface that is approximately coplanar with the external surface of the screen door track once the elongate support member is mounted between the screen door track on the lintel side and the screen door track on the lower side of the door opening;

inserting the first end of the elongate support member at a desired position along the track; and hingedly attaching the sliding screen door to the elongate support member, so that the sliding door is hingedly supported from the elongate support member to close off at least part of the door opening, and so that the screen door rests on the external surface when closing off at least part of the door opening.

4. A method according to claim 3 and further comprising attaching a means for retaining the screen door in a closed position, the means for retaining the screen door in a closed position being mounted on the external surface of the screen door track.

* * * * *